US007432901B2

(12) United States Patent
Baek et al.

(10) Patent No.: US 7,432,901 B2
(45) Date of Patent: Oct. 7, 2008

(54) DRIVING APPARATUS FOR LIQUID CRYSTAL DISPLAY

(75) Inventors: Jong Sang Baek, Kumi-shi (KR); Sun Young Kwon, Kumi-shi (KR)

(73) Assignee: LG Display Co., Ltd., Seoul (KR)

( * ) Notice: Subject to any disclaimer, the term of this patent is extended or adjusted under 35 U.S.C. 154(b) by 644 days.

(21) Appl. No.: 10/878,304

(22) Filed: Jun. 29, 2004

(65) Prior Publication Data

US 2004/0263454 A1 Dec. 30, 2004

(30) Foreign Application Priority Data

Jun. 30, 2003 (KR) ..... 10-2003-0043605

(51) Int. Cl.
*G09G 3/36* (2006.01)

(52) U.S. Cl. ..... 345/96; 345/209; 345/698

(58) Field of Classification Search ..... 345/94–98, 345/209, 87; 348/793
See application file for complete search history.

(56) References Cited

U.S. PATENT DOCUMENTS 5,365,284 A * 11/1994 Matsumoto et al. ..... 348/793
7,068,249 B2 * 6/2006 Kwon ..... 345/87

FOREIGN PATENT DOCUMENTS

| | | | |
|---|---|---|---|
| CN | 1276590 | A | 12/2000 |
| JP | 2000267618 | | 9/2000 |
| KR | 10020010001483 | A | 1/2001 |

* cited by examiner

*Primary Examiner*—Amr Awad
*Assistant Examiner*—Yong Sim
(74) *Attorney, Agent, or Firm*—McKenna Long & Aldridge LLP

(57) ABSTRACT

A driving apparatus for a liquid crystal display that reduces a residual direct current component from flowing in a liquid crystal is disclosed. In the apparatus, a liquid crystal display panel has liquid crystal cells at crossing of gate lines and data lines. An image signal processor separates a television image signal from a complex image signal and converts a polarity of the television image signal in response to a polarity inversion signal. A timing controller generates the gate control signal for time-dividing the plurality of gate lines to sequentially drive them during one horizontal period and driving the gate lines during one horizontal period and then applying it to the gate driver, and that generates the polarity inversion signal inverted for each one horizontal period and then applying it to the image signal processor.

10 Claims, 5 Drawing Sheets

DRIVING APPARATUS FOR LIQUID CRYSTAL DISPLAY

This application claims the benefit of the Korean Patent Application No. P2003-43605 filed in Korea on Jun. 30, 2003, which is hereby incorporated by reference for all purposes as if fully set forth herein.

BACKGROUND OF THE INVENTION

1. Field of the Invention

This invention relates to a liquid crystal display, and more particularly to an adaptive driving apparatus for a liquid crystal display that prevents a residual direct current component from flowing in a liquid crystal.

2. Description of the Related Art

Generally, a liquid crystal display (LCD) with an active matrix driving system uses thin film transistors (TFT's) as switching devices to display a natural moving picture. Because LCDs can be placed into a device smaller in size than existing cathode-ray tubes, it has been widely used as a monitor for personal or notebook computers as well as for office automation equipment such as copy machines, etc. and portable equipment such as cellular phones and pagers, etc.

The active matrix LCD displays a picture corresponding to video signals, such as television signals, on a picture element matrix, or pixel matrix, having liquid crystal cells arranged at crossings of gate lines and data lines. A thin film transistor is provided at each intersection between the gate lines and the data lines to thereby switch a data signal to be transmitted into the liquid crystal cell in response to a scanning signal (or gate pulse) from the gate line.

An LCD may be classified into either an NTSC signal system or a PAL signal system in accordance with a television signal system with which the device is to be used.

Generally, if an NTSC signal (i.e., 525 vertical lines) is inputted, then a horizontal resolution of the LCD is expressed in accordance with the number of sampled data while the vertical resolution thereof is expressed by a 234 line de-interlace scheme. On the other hand, if a PAL signal (i.e., 625 vertical lines) is inputted, then a horizontal resolution of the LCD is expressed in accordance with the number of sampled data while a vertical resolution thereof is expressed by a processing system similar to the NTSC signal scheme in which one line is removed for each six vertical lines to result in 521 lines.

Referring to FIG. 1 and FIG. 2, a related art LCD driving apparatus includes a liquid crystal display panel 30 having liquid crystal cells arranged in a matrix type, a gate driver 34 for driving gate lines GL of the liquid crystal display panel 30, a data driver 32 for driving data lines DL of the liquid crystal display panel 30, an image signal processor 10 for receiving an NTSC television signal and applying television complex signal, divided into RGB data signals R, G and B, to the data driver and to output a complex synchronizing signal Csync, and a timing controller 20 for receiving the complex synchronizing signal Csync from the image signal processor 10 to output a horizontal synchronizing signal Hsync and a vertical synchronizing signal Vsync and for generating a polarity inversion signal FRP that is applied it to the image signal processor 10, thereby controlling the data driver 32 and the gate driver 34.

The liquid crystal display panel 30 includes liquid crystal cells arranged in a matrix, and thin film transistors TFT provided at intersections between the gate lines GL and the data lines DL to be connected to the liquid crystal cells.

The thin film transistor TFT is turned on when a scanning signal, that is, a gate high voltage VGH from the gate line GL, is applied. This applies a pixel signal from the data line DL to the liquid crystal cell. The thin film transistor TFT is turned off when a gate low voltage VGL is applied from the gate line GL, to thereby maintain a pixel signal charged in the liquid crystal cell.

The liquid crystal cell can be equivalently expressed as a liquid crystal capacitor Clc, and includes a pixel electrode connected to a common electrode and the thin film transistor TFT that are opposite each other and having a liquid crystal therebetween. Further, the liquid crystal cell includes a storage capacitor Cst for maintaining the charged pixel signal until the next pixel is charged. This storage capacitor Cst is provided between a pre-stage gate line and the pixel electrode. Such a liquid crystal cell varies an alignment state of the liquid crystal having a dielectric anisotropy in response to the pixel signal charged via the thin film transistor TFT to control a light transmittance, thereby implementing a gray scale level.

The image signal processor 10 applies a gamma treatment of image signals (NTSC) supplied from the exterior thereof in consideration of a characteristic of the liquid crystal display panel 30, and converts polarities of the image signals (NTSC) using the polarity inversion signal FRP from the timing controller 20 for the purpose of prolonging a life of the liquid crystal, thereby generating RGB data. Further, the image signal processor 10 separates the complex synchronizing signal Csync from the image signals (NTSC) and applies it to the timing controller 20, and applies the RGB data to the data driver 32.

The timing controller 20 includes a frequency divider (not shown) for outputting a frequency-dividing signal having the same period as the complex synchronizing signal Csync and various clocks, and synchronizes the complex synchronizing signal Csync with the frequency-dividing signal with the aid of the phase locked loop PLL. The frequency-dividing signal is synchronized with a center portion of the width of the complex synchronizing signal Csync. The timing controller 20 generates a horizontal synchronizing signal Hsync inverted with respect to the complex synchronizing signal Csync using various clocks from the frequency divider. Further, the timing controller 20 generates data control signals SSP, SSC and SOE for controlling the timing of the data driver 32, and generates gate control signals GSP, GSC and GOE for controlling the timing of the gate driver 34 in order to apply it to the gate driver 34.

Moreover, the timing controller 20 includes a polarity inversion circuit for converting the polarities of the image signals (NTSC). This polarity inversion circuit applies a polarity inversion signal FRP for inverting the image signals (NTSC) to the image signal processor 10 during each desired period, such as, for each one field period or for each one horizontal period, in order to prevent the deterioration of the liquid crystal caused by residual direct current components applied to the liquid crystal.

The gate driver 34 sequentially applies the gate high voltage VGH to the gate lines GL in response to the gate control signals GSP, GSC and GOE from the timing controller 20. Thus, the gate driver 34 drives the thin film transistors TFT connected to the gate lines GL for each gate line.

More specifically, the gate driver 34 shifts a gate start pulse GSP in response to a gate shift pulse GSC to generate a shift pulse. Further, the gate driver 34 applies the gate high voltage VGH to the corresponding gate line GL every horizontal period H1, H2, . . . in response to the shift pulse. In this case, the gate driver 34 applies the gate high voltage VGH only in an enable period in response to a gate output enable signal GOE. On the other hand, the gate driver 34 applies the gate low voltage VGL in the remaining period when the gate high voltage VGH is not applied to the gate lines GL.

The data driver 32 applies pixel data signals for each horizontal line to the data lines DL every horizontal period 1H, 2H, . . . in response to data control signals SSP, SSC and SOE from the timing controller 20. Particularly, the data driver 32 applies RGB data from the image signal processor 10 to the liquid crystal display panel 30.

More specifically, the data driver 32 shifts a source start pulse SSP in response to a source shift clock SSC to generate a sampling signal. Then, the data driver 32 sequentially inputs analog RGB data for each unit in response to the sampling signal to latch them. Further, the data driver 32 applies the latched analog data for one line to the data lines DL.

The related art LCD driving apparatus and method controls polarities of image signals (NTSC) applied to the liquid crystal display panel 30 using the polarity inversion signal FRP applied from the timing controller 20 to the image signal processor 10, thereby preventing residual current components from flowing in the liquid crystal and thus preventing a deterioration of the liquid crystal.

Meanwhile, the conventional LCD driving apparatus and method supplies and displays the same data on at least two horizontal lines during one horizontal period when image signals A adopting the NTSC system are displayed, thereby being enlarged into the entire field of the liquid crystal display panel 30 as shown in FIG. 2. When RGB data are displayed enlarged in the vertical direction of the liquid crystal display panel 30, a zero-level voltage or a desired level of direct current voltage is applied to the liquid crystal for a long time. Therefore, if a direct current voltage is left at the liquid crystal for a long time, then the liquid crystal molecules deteriorate.

SUMMARY OF THE INVENTION

Accordingly, the present invention is directed to a driving apparatus for a liquid crystal display that substantially obviates one or more of the problems due to limitations and disadvantages of the related art.

Accordingly, it is an advantage of the present invention to provide an adaptive driving apparatus for a liquid crystal display that prevents a residual direct current component from flowing in a liquid crystal.

In order to achieve these and other advantages of the invention, a driving apparatus for a liquid crystal display according to one aspect of the present invention includes a liquid crystal display panel having liquid crystal cells provided at each intersection between a plurality of gate lines and a plurality of data lines; an image signal processor for separating a television image signal from a complex image signal from the exterior thereof and for converting a polarity of the television image signal in response to a polarity inversion signal; a data driver for applying the television image signal from the image signal processor to the data lines; a gate driver for driving the gate lines in response to a gate control signal; and a timing controller for generating the gate control signal for time-dividing the plurality of gate lines to sequentially drive them during one horizontal period and driving the gate lines during one horizontal period and then applying it to the gate driver, and for generating the polarity inversion signal inverted for each one horizontal period and then applying it to the image signal processor.

In the driving apparatus, the gate control signal is a gate shift clock shifting a gate high voltage for driving the gate lines.

The gate signal includes a first period, having a relatively large period, generated in a portion of the one horizontal period; a second period, having a period smaller than the first period, generated in the remaining interval of the one horizontal period, the second period following the first period; and a third period having the same period as the one horizontal period, the third period following the second period.

Herein, the gate driver drives the plurality of gate lines, in response to the control signal having the first and second periods, during a M horizontal period; drives the plurality of gate lines, in response to the control signal having the first and second periods, during a (M+1) horizontal period; drives the plurality of gate lines, in response to the control signal having the third period, during a (M+2) horizontal period; and drives the plurality of gate lines, in response to the control signal having the third period, during a (M+3) horizontal period.

Herein, the gate control signal periodically repeats the M to (M+3) horizontal periods.

The polarity inversion signal is inverted every odd field and every even field.

A method of driving a liquid crystal display according to another aspect of the present invention includes the steps of providing a liquid crystal display panel having liquid crystal cells provided at each intersection between a plurality of gate lines and a plurality of data lines; generating a polarity inversion signal inverted for each one horizontal period; separating a television image signal from a complex image signal from the exterior thereof and converting a polarity of the television image signal in response to the polarity inversion signal; generating the gate control signal for time-dividing the plurality of gate lines to sequentially drive them during one horizontal period and for driving the gate lines during one horizontal period; driving the gate lines in response to the gate control signal; and applying the television image signal to the data line in synchronization with the driving of the gate lines.

In the method, the gate control signal is a gate shift clock shifting a gate high voltage for driving the gate lines.

The gate signal includes a first period, having a relatively large period, generated in a portion of the one horizontal period; a second period, having a period smaller than the first period, generated in the remaining interval of the one horizontal period, the second period following the first period; and a third period having the same period as the one horizontal period, the third period following the second period.

Herein, the step of driving the gate lines includes driving the plurality of gate lines, in response to the control signal having the first and second periods, during a M horizontal period; driving the plurality of gate lines, in response to the control signal having the first and second periods, during a (M+1) horizontal period; driving the plurality of gate lines, in response to the control signal having the third period, during a (M+2) horizontal period; and driving the plurality of gate lines, in response to the control signal having the third period, during a (M+3) horizontal period.

Herein, the gate control signal periodically repeats the M to (M+3) horizontal periods.

Herein, the polarity inversion signal is inverted every odd field and every even field.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

These and other objects of the invention will be apparent from the following detailed description of the embodiments of the present invention with reference to the accompanying drawings, in which.

DETAILED DESCRIPTION OF THE EMBODIMENTS

Reference will now be made in detail to embodiments of the present invention, examples of which are illustrated in the accompanying drawings.

Figure 1:
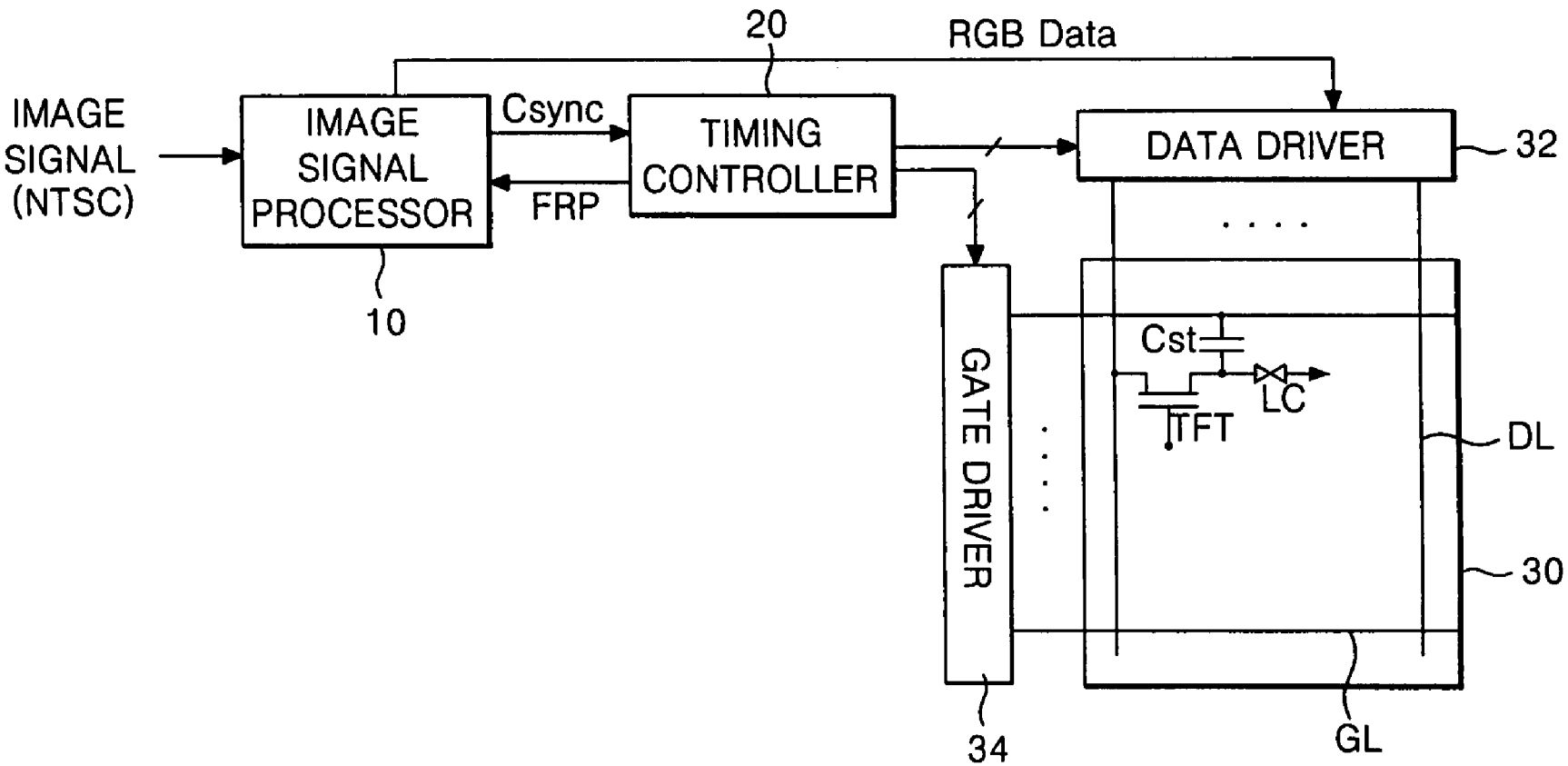
FIG. 1 RELATED ART
FIG. 1 is a schematic block diagram illustrating a configuration of a conventional driving apparatus for a liquid crystal display.
Figure 2:
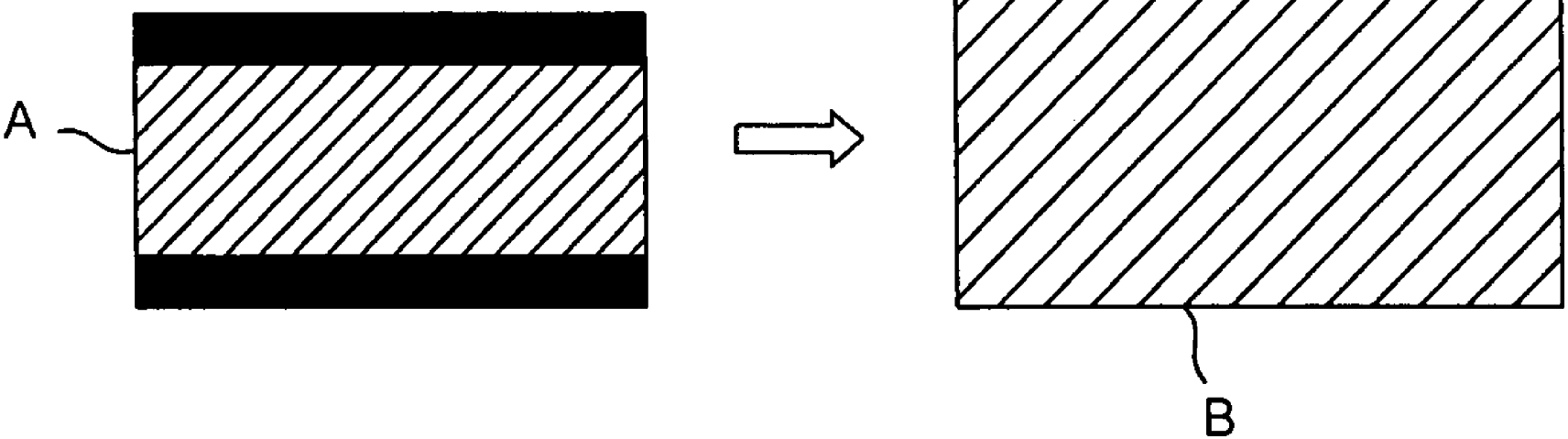
FIG. 2 RELATED ART
FIG. 2 illustrates NTSC image signals displayed on the entire field of the liquid crystal display panel shown in FIG. 1.
Figure 3:
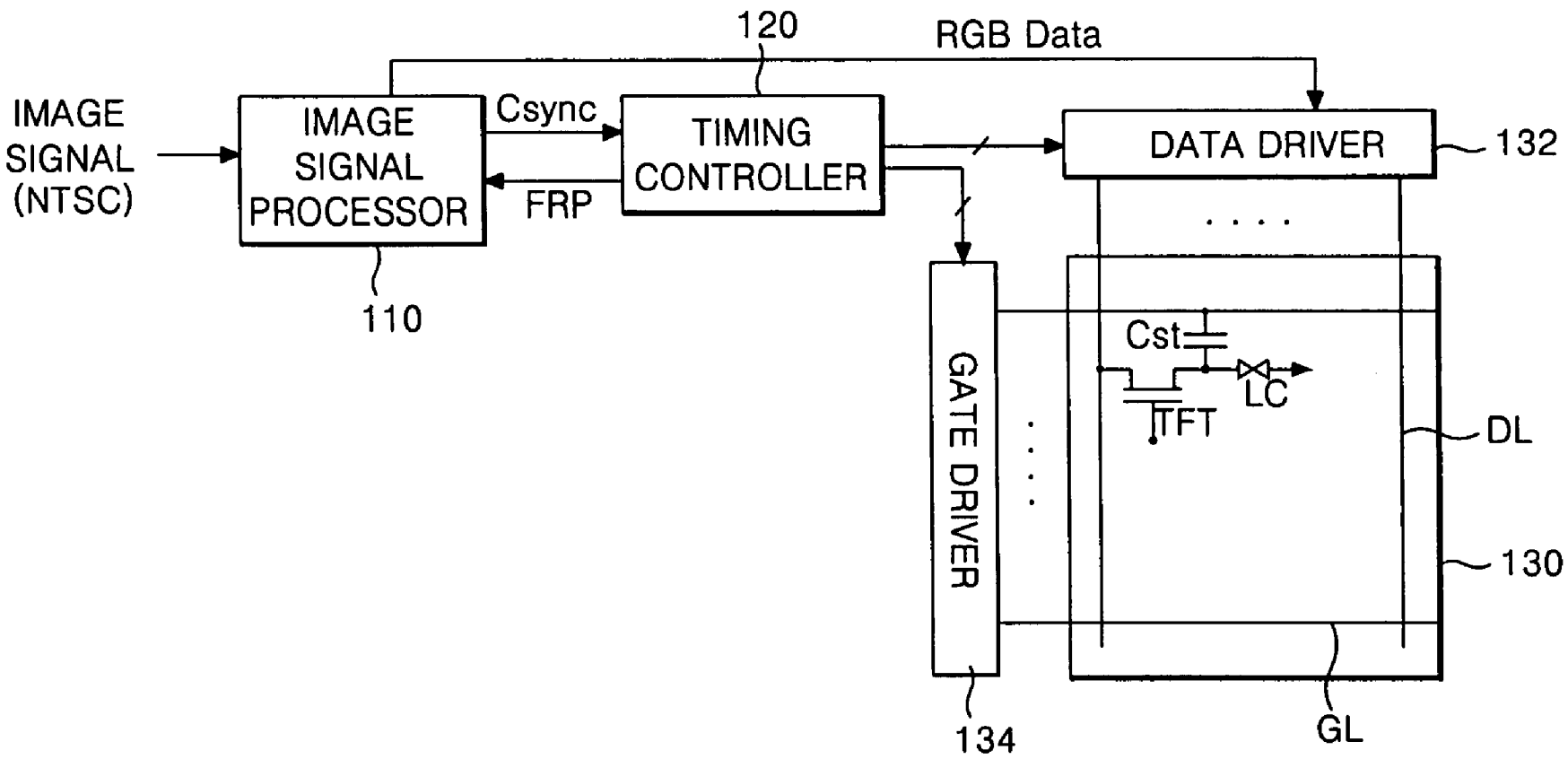
FIG. 3 is a schematic block diagram illustrating a configuration of a driving apparatus for a liquid crystal display according to an embodiment of the present invention.
Figure 4:
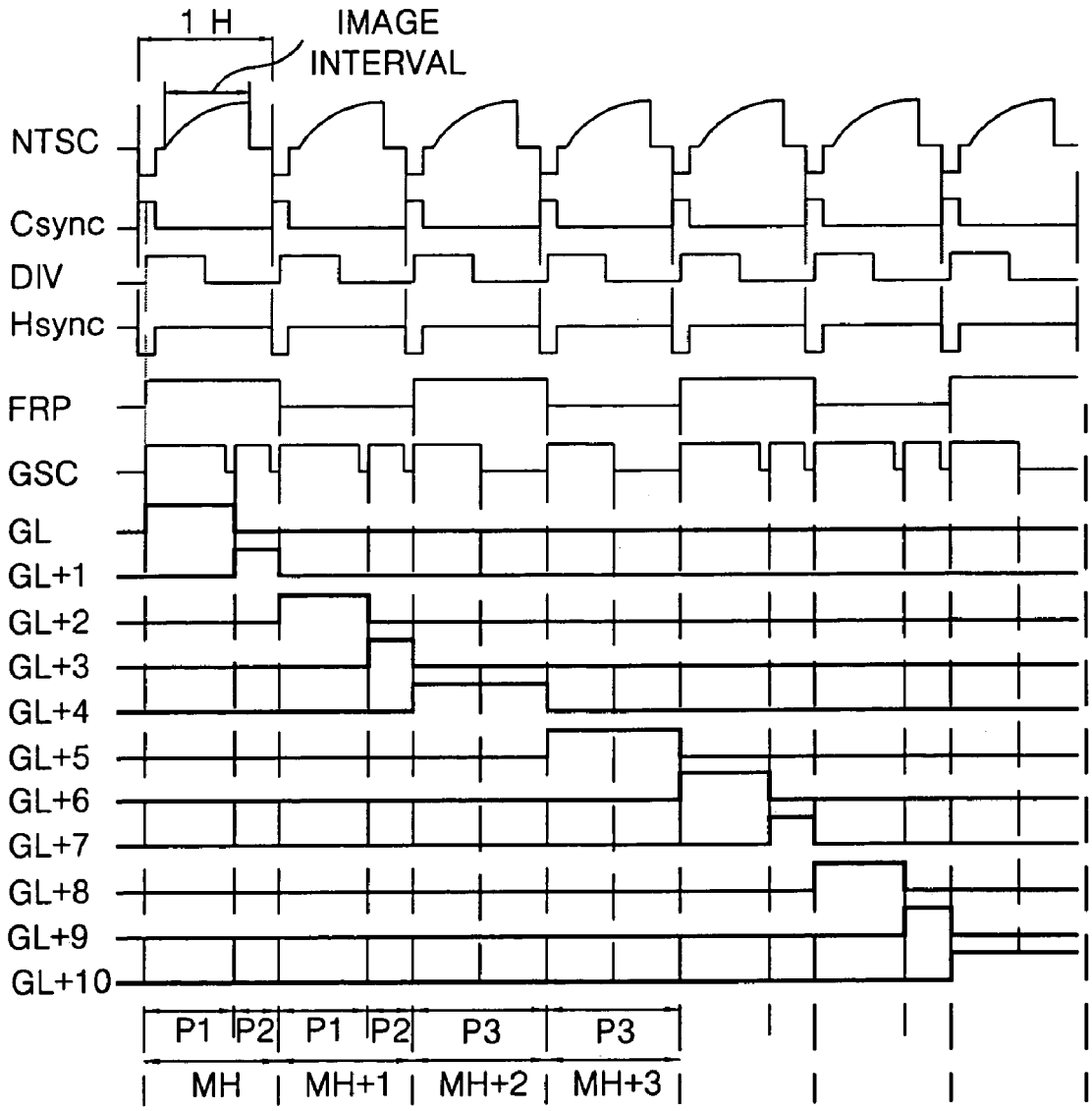
FIG. 4 is a waveform diagram of driving signals in a method of driving a liquid crystal display according to an embodiment of the present invention.

Referring to FIG. 3 and FIG. 4, an LCD driving apparatus according to an exemplary embodiment of the present invention includes liquid crystal display panel 130 having liquid crystal cells arranged in a matrix, a gate driver 134 for driving gate lines GL of the liquid crystal display panel 130, a data driver 132 for driving data lines DL of the liquid crystal display panel 130, an image signal processor 110 for receiving an NTSC television signal and applying a television complex signal, divided into RGB data signals R, G and B, to the data driver and outputting a complex synchronizing signal Csync, and a timing controller 120 for receiving the complex synchronizing signal Csync from the image signal processor 110 and to divide csync into a horizontal synchronizing signal Hsync and a vertical synchronizing signal Vsync and for generating a polarity inversion signal FRP to apply it to the image signal processor 110, thereby controlling a driving of the data driver 132 and the gate driver 134.

The liquid crystal display panel 130 includes liquid crystal cells arranged in a matrix, and thin film transistors TFT at crossings of the gate lines GL and the data lines DL in the liquid crystal cells.

The thin film transistor TFT is turned on when a scanning signal, that is, a gate high voltage VGH from the gate line GL is applied, to thereby apply a pixel signal from the data line DL to the liquid crystal cell. On the other hand, the thin film transistor TFT is turned off when a gate low voltage VGL is applied from the gate line GL, to thereby maintain the pixel signal charged in the liquid crystal cell.

The liquid crystal cell can be equivalently expressed as a liquid crystal capacitor Clc, and includes a pixel electrode connected to a common electrode and the thin film transistor TFT that are opposite to each other having liquid crystal therebetween. Further, the liquid crystal cell includes a storage capacitor Cst for maintaining the charged pixel signal until the next pixel is charged. This storage capacitor Cst is provided between a pre-stage gate line and the pixel electrode. Such a liquid crystal cell varies an alignment state of the liquid crystal having a dielectric anisotropy in response to the pixel signal charged via the thin film transistor TFT to control a light transmittance, thereby implementing a gray scale level.

The image signal processor 110 a gamma processes the image signals (NTSC) supplied from the exterior thereof based upon a characteristic of the liquid crystal display panel 130, and converts the polarities of the image signals (NTSC) using the polarity inversion signal FRP from the timing controller 120 for the purpose of prolonging the life of the liquid crystal, thereby generating RGB data. Further, the image signal processor 10 separates a complex synchronizing signal Csync from the image signals (NTSC) in order to apply it to the timing controller 20 and applies the RGB data to the data driver 132.

The timing controller 120 includes a frequency divider (not shown) for outputting a frequency-divided signal DIV having the same period as the complex synchronizing signal Csync and various clocks, and synchronizes the complex synchronizing signal Csync with the frequency-divided signal DIV with the aid of a phase locked loop PLL. Herein, the frequency-divided signal is synchronized with a center portion of the width of the complex synchronizing signal Csync. The timing controller 120 generates a horizontal synchronizing signal Hsync inverted with respect to the complex synchronizing signal Csync using various clocks from the frequency divider. Further, the timing controller 120 comprises a polarity inversion circuit for converting the polarities of the image signals (NTSC). This polarity inversion circuit generates a polarity inversion signal FRP inverted for each horizontal period 1H for the purpose of preventing the liquid crystal from deteriorating due to residual direct current components before applying it to the image signal processor 110. In this case, the polarity inversion signal FPR is inverted every odd field and every even field.

Meanwhile, the timing controller 120 generates data control signals SSP, SSC and SOE for controlling the timing of the data driver 132 in order to apply them to the data driver 132, and generates gate control signals GSP, GSC and GOE for controlling the timing of the gate driver 134 to apply them to the gate driver 134. In this case, the timing controller 120 generates a gate shift clock GSC for applying input image signals (NTSC) to two horizontal lines of the liquid crystal display panel 130 during an Mth horizontal period MH; applying negative RGB data to two horizontal lines of the liquid crystal display panel 130 during a (M+1)th horizontal period MH+1; applying positive RGB data to one horizontal line of the liquid crystal display panel 130 during a (M+2)th horizontal period MH+2; and applying negative RGB data to one horizontal line during a (M+3)th horizontal period MH+3 such that a direct current voltage is not applied to the liquid crystal when the input image signals (NTSC) are enlarged in the vertical direction. The controller 120 then applies it to the gate driver 134.

The gate shift clock GSC periodically repeats the Mth to (M+3)th horizontal periods MH, MH+1, MH+2 and MH+3. Herein, the Mth horizontal period MH has two periods; the (M+1)th horizontal period MH+1 has two periods; the (M+2) th horizontal period MH+2 has one period; and the (M+3)th horizontal period MH+3 has one period. In each of the Mth and (M+1)th periods, the gate shift clock GSC is comprised of a first period P1 having a relatively large period, and a second period P2 having a period smaller than the first period P1. Also, in each of the (M+2)th and (M+3)th horizontal periods MH+2 and MH+3, the gate shift clock GSC has a third period P3 equal to one horizontal period 1H.

The data driver 132 applies RGB data from the image signal processor 110 having polarities converted by the polarity inversion signal FRP from the timing controller 120 for each line every horizontal period 1H, 2H, . . . in response to data control signals SSP, SSC and SOE from the timing controller 120. The RGB data having the converted polarities has polarities inverted for each one horizontal period, and has polarities inverted every odd field and every even field.

More specifically, the data driver 132 shifts a source start pulse SSP in response to a source shift clock SSC to generate a sampling signal. Then, the data driver 132 sequentially inputs analog RGB data for each certain unit in response to the sampling signal to latch them. Further, the data driver 132 applies the latched analog data for one line to the data lines DL.

The gate driver 134 sequentially applies the gate high voltage VGH to the gate lines GL in response to the gate control signals GSP, GSC and GOE from the timing controller 120. In other words, the gate driver 134 shifts a gate start pulse GSP in response to the gate shift clock GSC to generate a shift pulse. Further, the gate driver 134 applies the gate high voltage VGH to the corresponding gate line GL in response to the shift pulse. In this case, the gate driver 134 applies the gate high voltage VGH only in an enable period in response to a gate output enable signal GOE.

Accordingly, as illustrated in FIG. 4, the gate driver 134 applies the gate high voltage VGH to the N gate line GL, in response to the gate shift clock GSC having the first period P1 from the timing controller 120, during the Mth horizontal period MH and thereafter applies the gate high voltage VGH to the (N+1)th gate line GL+1, in response to the gate shift clock GSC having the second period P2 from the timing controller 120, during the remaining Mth horizontal period MH. Further, the gate driver 134 applies the gate high voltage VGH to the (N+2)th gate line GL+2, in response to the gate shift clock GSC having the first period P1 from the timing controller 120, during the (M+1)th horizontal period MH+1 and thereafter applies the gate high voltage VGH to the (N+3) th gate line GL+3, in response to the gate shift clock GSC having the second period P2 from the timing controller 120, during the remaining (M+1)th horizontal period MH+1. Furthermore, the gate driver 134 applies the gate high voltage VGH to the (N+4)th gate line GL+4, in response to the gate shift clock GSC having the third period P3 from the timing controller 120, during the (M+1)th horizontal period MH+1 and thereafter applies the gate high voltage VGH to the (N+5) th gate line GL+5, in response to the gate shift clock GSC having the third period P3 from the timing controller 120, during the (M+3)th horizontal period MH+1. Such a gate driver 134 repeats the Mth to (M+3)th horizontal periods MH to MH+3 to apply the gate high voltage VGH to the gate lines GL in response to the gate shift clock GSC from the timing controller 120. Moreover, the gate driver 134 applies the gate low voltage VGL to the gate lines GL in the remaining interval when the gate high voltage VGH is not supplied.

Figure 5:
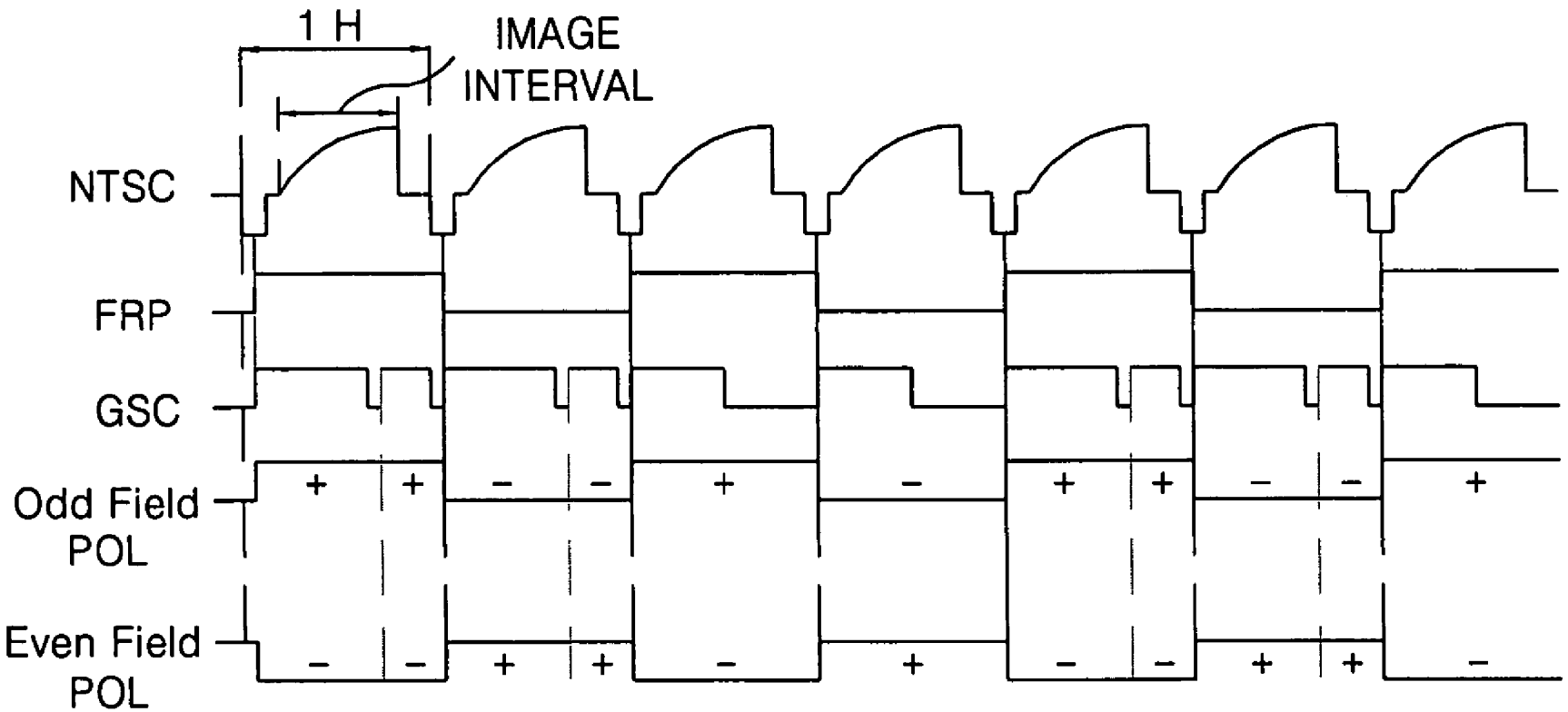
FIG. 5 is a waveform diagram illustrating a polarity inversion of RGB data signals displayed on the liquid crystal display panel shown in FIG. 3.

As shown in FIG. 5, a LCD driving method according to an embodiment of the present invention is divided into a step of sequentially applying a gate high voltage VGH to two gate lines, in response to the gate shift clock GSC having the first and second periods P1 and P2, and supplying positive(+) RGB data synchronized with the gate high voltage VGH to the data lines during the Mth horizontal period MH in the odd field interval, and sequentially applying a gate high voltage VGH to two gate lines, in response to the gate shift clock GSC having the first and second periods P1 and P2, and supplying negative(−) RGB data synchronized with the gate high voltage VGH to the data lines during the (M+1)th horizontal period MH+1 in the odd field interval, thereby enlarging and displaying the RGB data; and a step of sequentially applying a gate high voltage VGH to one gate line, in response to the gate shift clock GSC having the third period P3, and supplying positive(+) RGB data synchronized with the gate high voltage VGH to the data lines during the (M+2)th horizontal period MH+2, and sequentially applying a gate high voltage VGH to one gate line, in response to the gate shift clock GSC having the third period P3, and supplying negative(−) RGB data synchronized with the gate high voltage VGH to the data lines during the (M+3)th horizontal period MH+3 in the odd field interval, thereby displaying the RGB data, as they are, without enlarging them. Also, in the odd field interval, inverted RGB data are supplied to the liquid crystal panel 130 in a manner similar to the even field interval.

Accordingly, the LCD driving method according to an embodiment of the present invention inverts the polarities of RGB data for both each horizontal period and for each field when the RGB data are enlarged in the vertical direction. Furthermore, the LCD driving method according to the embodiment of the present invention applies the enlarged and displayed RGB data to the horizontal lines on a time-divisional basis during one horizontal period, thereby preventing a residual direct current voltage from flowing in the liquid crystal for a long time.

As described above, the LCD driving method and apparatus according to the present invention time-divides the RGB data that is inverted every odd field and every even field and inverted for each one horizontal period and then applies them to the horizontal lines during one horizontal period, thereby enlarging and displaying the RGB data; and applies the RGB data to the horizontal lines during one horizontal period, thereby displaying the RGB data, as they are, without enlarging them, so that it can reduce the residual direct current voltage from flowing in the liquid crystal for a long time and thus prevent a deterioration of the liquid crystal.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a liquid crystal display, comprising:

a liquid crystal display panel having liquid crystal cells at each crossing of a plurality of gate lines and a plurality of data lines;

an image signal processor that separates a television image signal from a complex image signal and that converts a polarity of the television image signal in response to a polarity inversion signal;

a data driver that applies the television image signal from the image signal processor to the data lines;

a gate driver that drives the gate lines in response to a gate control signal; and a timing controller that generates the gate control signal for driving the gate lines during one horizontal period and applies the gate control signal to the gate driver that time-divides the plurality of gate lines to sequentially drive the plurality of gate lines for periods of differing durations during one horizontal period, and that generates the polarity inversion signal inverted for each one horizontal period and applies the generated polarity inversion signal to the image signal processor, wherein the gate control signal includes:

a first period generated in a portion of the one horizontal period;

a second period, having a period smaller than the first period, generated in the remaining interval of the one horizontal period, the second period following the first period; and a third period having the same period as the one horizontal period, the third period following the second period.

2. The driving apparatus as claimed in claim 1, wherein the gate control signal is a gate shift clock shifting a gate high voltage for driving the gate lines.

3. The driving apparatus as claimed in claim 1, wherein the gate driver;

drives the plurality of gate lines, in response to the control signal having the first and second periods, during a Mth horizontal period;

drives the plurality of gate lines, in response to the control signal having the first and second periods, during a (M+1)th horizontal period;

drives the plurality of gate lines, in response to the control signal having the third period, during a (M+2)th horizontal period; and drives the plurality of gate lines, in response to the control signal having the third period, during a (M+3)th horizontal period.

4. The driving apparatus as claimed in claim 3, wherein the gate control signal periodically repeats the Mth to (M+3)th horizontal periods.

5. The driving apparatus as claimed in claim 1, wherein the polarity inversion signal is inverted every odd field and every even field.

6. A method of driving a liquid crystal display, comprising:

providing a liquid crystal display panel having liquid crystal cells at each crossing of a plurality of gate lines and a plurality of data lines;

generating a polarity inversion signal inverted for each one horizontal period;

separating a television image signal from a complex image signal from the exterior thereof and converting a polarity of the television image signal in response to the polarity inversion signal;

generating the gate control signal for time-dividing the plurality of gate lines to sequentially drive the plurality of gate lines for periods of different duration during one horizontal period and for driving the gate lines during one horizontal period;

driving the gate lines in response to the gate control signal; and applying the television image signal to the data line in synchronization with the driving of the gate lines, wherein the gate control signal includes:

a first period generated in a portion of the one horizontal period;

a second period, having a period smaller than the first period, generated in the remaining interval of the one horizontal period, the second period following the first period; and a third period having the same period as the one horizontal period, the third period following the second period.

7. The method as claimed in claim 6, wherein the gate control signal is a gate shift clock shifting a gate high voltage for driving the gate lines.

8. The method as claimed in claim 6, wherein the step of driving the gate lines includes the steps of:

driving the plurality of gate lines, in response to the control signal having the first and second periods, during a Mth horizontal period;

driving the plurality of gate lines, in response to the control signal having the first and second periods, during a (M+1)th horizontal period;

driving the plurality of gate lines, in response to the control signal having the third period, during a (M+2)th horizontal period; and driving the plurality of gate lines, in response to the control signal having the third period, during a (M+3)th horizontal period.

9. The method as claimed in claim 8, wherein the gate control signal periodically repeats the Mth to (M+3)th horizontal periods.

10. The method as claimed in claim 6, wherein the polarity inversion signal is inverted every odd field and every even field.

* * * * *